US012805609B2

(12) United States Patent
Christian et al.

(10) Patent No.: US 12,805,609 B2
(45) Date of Patent: Nov. 24, 2026

(54) DEVICE FOR ARTICULATION OF TWO TIMEPIECE COMPONENTS

(71) Applicant: ROLEX SA, Geneva (CH)

(72) Inventors: Martin Christian, Loisy (FR); Stéphane Dufour, Vessy (CH); Thibaut Riotte, Pringy (FR); Jean-Baptiste Robin, Annemasse (FR)

(73) Assignee: ROLEX SA, Geneva (CH)

( * ) Notice: Subject to any disclaimer, the term of this patent is extended or adjusted under 35 U.S.C. 154(b) by 235 days.

(21) Appl. No.: 18/518,922

(22) Filed: Nov. 24, 2023

(65) Prior Publication Data

US 2024/0188693 A1 Jun. 13, 2024

(30) Foreign Application Priority Data

Dec. 9, 2022 (EP) ..... 22212619

(51) Int. Cl.
*A44C 5/14* (2006.01)

(52) U.S. Cl.
CPC ..... *A44C 5/14* (2013.01)

(58) Field of Classification Search
CPC ..... A44C 5/14; G04B 37/1486
See application file for complete search history.

(56) References Cited

U.S. PATENT DOCUMENTS 6,014,793 A * 1/2000 Howald ..... A44C 5/147 24/265 B
7,730,710 B2 6/2010 Rejzner
(Continued)

FOREIGN PATENT DOCUMENTS

CH 707779 A2 9/2014
CH 715977 A2 9/2020
(Continued)

OTHER PUBLICATIONS

EP_3480665_A1 Machine Translation from PE2E search (Year: 2019).*
(Continued)

*Primary Examiner* — Edwin A. Leon
*Assistant Examiner* — Kevin Andrew Johnston
(74) *Attorney, Agent, or Firm* — Seckel IP, PLLC

(57) ABSTRACT

Device for articulation of two timepiece components (10, 20) including first and second timepiece components connected to one another in an articulated manner using at least one articulation pin (1), wherein the two timepiece components each include first and second guide surfaces that cooperate with first and second articulation surfaces (1*a*, 1*e*) respectively of at least one articulation portion of the at least one articulation pin (1), the guide surfaces and the respective articulation surfaces being positioned face-to-face to guide by rubbing the movement in rotation of the respective timepiece components (10, 20) relative to the at least one articulation pin (1), the at least one articulation portion of the articulation pin (1) or the at least one articulation pin (1) is-being made entirely of ceramic, the at least one articulation pin (1) including at least one portion of lower strength positioned out of reach of the guide surfaces of the respective timepiece components, and the at least one articulation portion of the articulation pin (1) or the at least one articulation pin (1) including an entirely continuous peripheral surface with no sharp edges, or wherein-any section of the at least one articulation portion or of the articulation pin (1) on a median longitudinal plane and any section of the at least one articulation portion or of the articulation pin on a transverse plane having a contour of continuous shape.

23 Claims, 5 Drawing Sheets

(56) References Cited

U.S. PATENT DOCUMENTS

| | | | | |
|---|---|---|---|---|
| 10,359,739 | B2 * | 7/2019 | Vuille | A44C 5/14 |
| 2006/0261106 | A1 * | 11/2006 | Hiranuma | G04B 37/1486 224/178 |
| 2009/0113870 | A1 * | 5/2009 | Rejzner | A44C 5/107 59/80 |
| 2017/0360163 | A1 * | 12/2017 | Catheline | G04B 31/00 |

FOREIGN PATENT DOCUMENTS

| | | | | |
|---|---|---|---|---|
| EP | 2057914 | A1 | 5/2009 | |
| EP | 3480665 | A1 * | 5/2019 | A44C 5/14 |

OTHER PUBLICATIONS

European Search Report and Written Opinion dated May 26, 2023 in priority application No. EP22212619.5; with English machine translation (total 16 pages).

* cited by examiner

DEVICE FOR ARTICULATION OF TWO TIMEPIECE COMPONENTS

This application claims priority of European patent application No. EP 22212619.5 filed Dec. 9, 2022, the content of which is hereby incorporated by reference herein in its entirety.

BACKGROUND ART

The invention concerns a device for articulation of two timepiece components. It also relates to a timepiece as such including at least one such articulation device.

Various devices are used to fix together in an articulated manner two timepiece components, such as a part of a strap and a case of a wristwatch. In accordance with routine common prior art solution a watch middle has two pairs of horns, each pair of horns delimiting a housing to receive a link at the end of a part of a strap. A pin extending between the two horns of a pair of horns comes to be engaged with this link of the part of a strap, holding it in position between the two horns, while enabling relative articulation of the part of a strap and the watch case, by pivoting about this pin.

This way of mounting a part of a strap on a watch case, in particular on a middle, and likewise more generally an articulated assembly of two timepiece components, must ideally achieve the following objectives:

- it must be reliable, more particularly to avoid any untimely detachment of the part of a strap;
- it must be robust, and in particular prevent any wear, in particular because of the friction associated with the articulated movement of the two components, which would degrade its functionality over time;
- it must preferably enable user-friendly removal withdrawal and fixing of a timepiece component, for example enabling its easy and rapid replacement;
- it must have an attractive aesthetic appearance, in particular be compatible with the aesthetic requirements of top of the range timepieces.

SUMMARY OF THE INVENTION

Existing solutions achieve the above objectives at least in part, but remain open to improvement. The present invention therefore has for an objective improving on the current situation.

The general object of the invention is therefore to define an improved solution for the articulated assembly of two timepiece components.

To be more precise, an object of the invention is to define a reliable and robust solution for articulation of two timepiece components.

To this end, the invention is based on a device for articulation of two timepiece components including at least one articulation pin and first and second timepiece components connected to one another in an articulated manner by means of the at least one articulation pin, wherein said two timepiece components each include first and second guide surfaces that cooperate with first and second articulation surfaces respectively of at least one articulation portion of the at least one articulation pin, said guide surfaces and said respective articulation surfaces being positioned face-to-face to guide by rubbing the movement in rotation of the respective timepiece components relative to said at least one articulation pin, the at least one articulation portion of the articulation pin or the at least one articulation pin being made entirely of ceramic, wherein the at least one articulation pin includes at least one portion of lower strength positioned out of reach of said guide surfaces of said respective timepiece components, and wherein the at least one articulation portion of the articulation pin or the at least one articulation pin includes an entirely continuous peripheral surface with no sharp edges, or wherein any section of the at least one articulation portion or of the articulation pin on a median longitudinal plane and any section of the at least one articulation portion or of the articulation pin on a transverse plane has a contour of continuous shape.

The invention is more precisely defined by the claims.

BRIEF DESCRIPTION OF THE DRAWINGS

These objects, features and advantages of the present invention are described in detail in the following description of particular embodiments given by way of non-limiting example with reference to the appended figures, in which.

DETAILED DESCRIPTION OF PARTICULAR EMBODIMENTS

Figure 1:
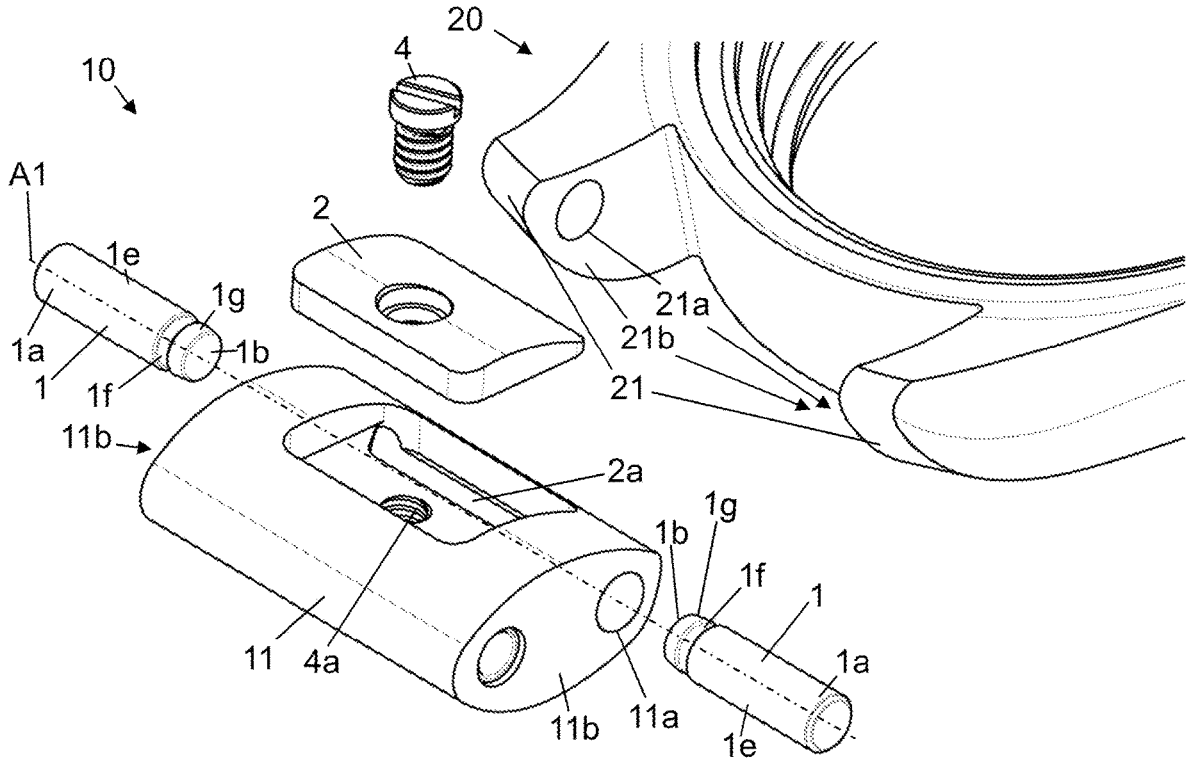
FIG. 1 represents an exploded perspective view of a device in accordance with a first embodiment of the invention for articulating a part of a strap onto a watch middle.

To simplify the description of the invention identical or corresponding elements of the various embodiments bear the same reference numbers.

FIGS. 1 to 5 depict a first embodiment of an articulation device in accordance with the invention including a connecting element 11 arranged at the end of a part of a strap 10, a receiving element 21 that takes the form of two substantially parallel and facing horns on a middle 20, and two articulation pins 1 intended to fix together the connecting element 11 and the receiving element 21, that is to say a part of a strap 10 on a middle 20, in an articulated manner In this embodiment the connecting element 11 takes the form of a part of a strap forming a connecting link. This connecting link is intended to be arranged at the end of a part of a strap 10. It advantageously has the same shape and the same appearance as the other parts of a strap.

Each horn of the receiving element 21 of the middle 20 includes a bore 21*a* that in particular takes the form of a blind hole. The respective bores 21*a* of the two horns are arranged on preferably substantially aligned axes. The bores 21*a* preferably have a circular cross section. The openings of the two bores are oriented toward one another. The space between the two horns defines a housing intended to be occupied by the connecting link of the part of a strap. The visible exterior surface of the horns does not feature any modification or any discontinuity that would degrade its appearance. Nevertheless, as an alternative, the two bores could be through-holes and/or be provided with bearing surfaces and/or have non-parallel orientations with respect to one another.

Figure 2:
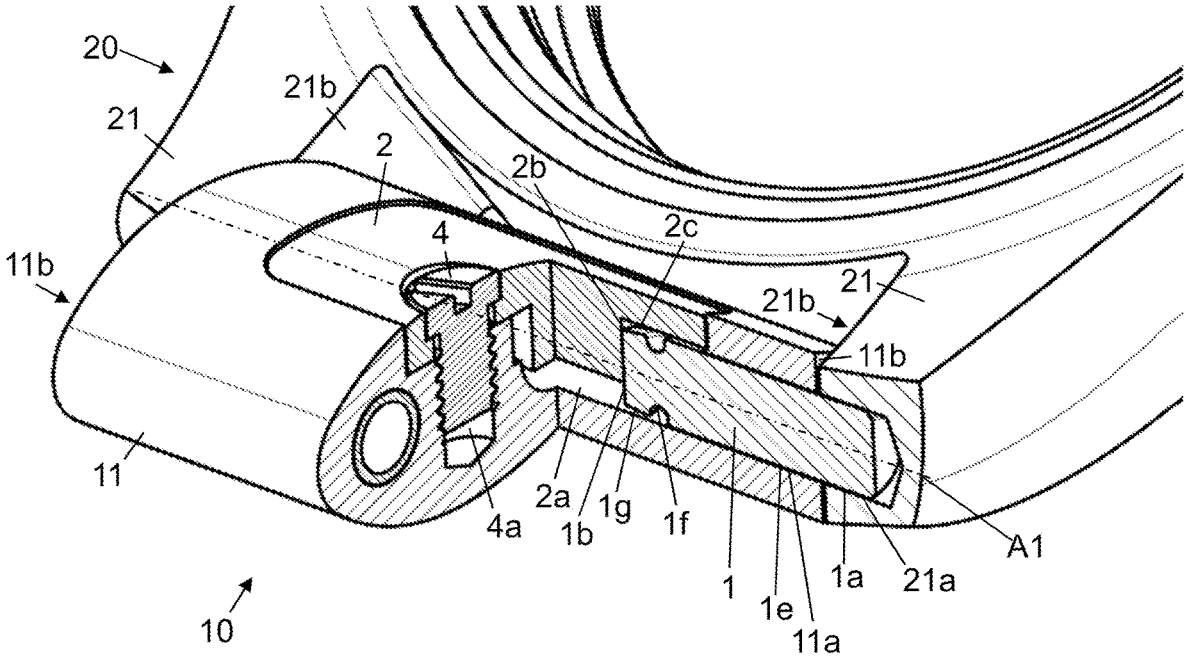
FIG. 2 represents a partially truncated perspective view of the device in accordance with the first embodiment of the invention for articulating a part of a strap on a watch middle, in an articulated fixing configuration.
Figure 3:
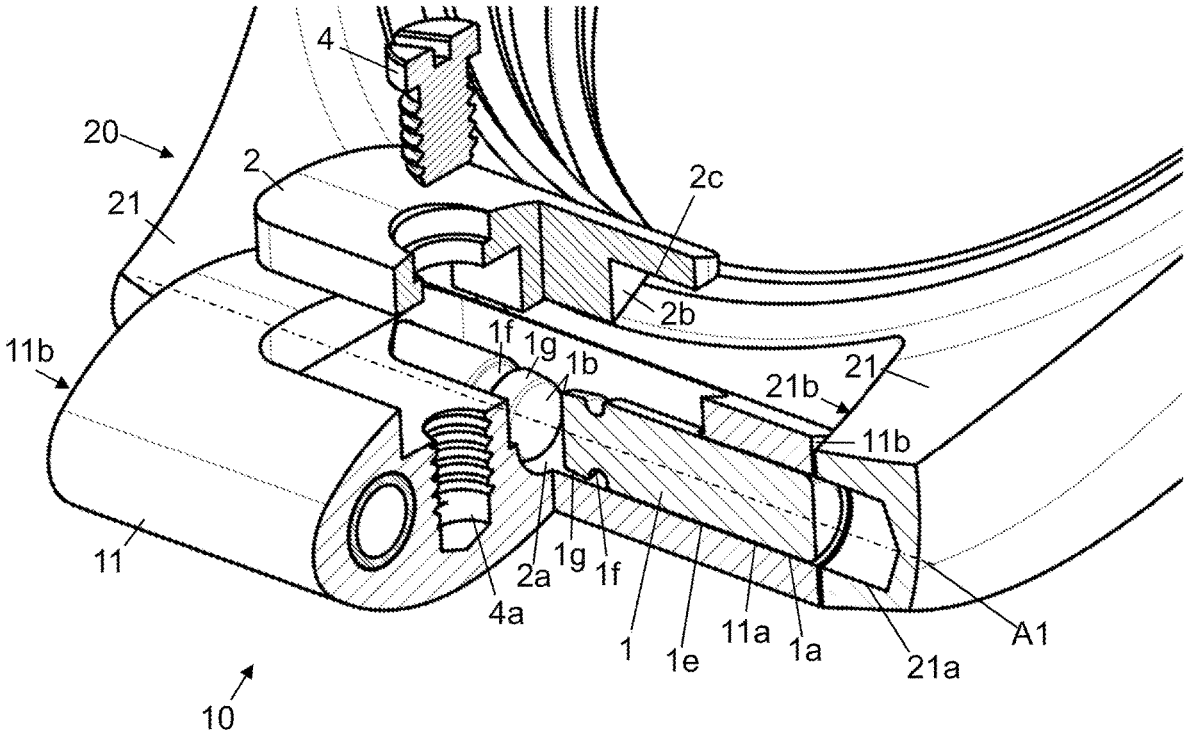
FIG. 3 represents a partially truncated perspective view of the device in accordance with the first embodiment of the invention for articulating a part of a strap on a watch middle in which the articulation pins are in a retracted position.

The articulation device further includes two articulation pins 1 intended to fix together or not, in articulated manner, the connecting element 11 and the receiving element 21. Note that the term "fixing" must be understood as meaning that the two timepiece components concerned cannot be detached from one another when they are fixed. Nevertheless, they retain at least one degree of freedom of movement in rotation relative to one another by means of at least one articulation pin, which produces an articulated fixing. As described in more detail hereinafter each articulation pin 1 is able to occupy two positions, a position projecting from the connecting element 11, as represented in FIG. 2, and a position retracted inside a housing 11*a* of the connecting element 11, as represented in FIG. 3.

Thus the articulation device is designed to occupy at least two configurations:

- a first configuration in which the articulation pins 1 occupy a position retracted into the connecting element, enabling separation of a part of a strap from a watch middle; and
- a second configuration in which the articulation pins 1 are retained in a position projecting from the connecting element 11 and are positioned in the respective bores 21*a* of the receiving element 21 so as therefore to fix together in articulated manner the connecting element 11 and the receiving element 21 and thus part of a strap to a watch middle.

Each articulation pin 1 is positioned in a housing 11*a* in the connecting element 11. Two housings 11*a* preferably extend along the same axis A1. Furthermore, the housings 11*a* take the form of a transverse through-hole. This hole therefore opens onto the two opposite lateral walls or flanks 11*b* of the connecting element. Each housing 11*a* allows an articulation pin 1 to slide freely along the axis A1 with one degree of freedom of movement in translation. This degree of freedom of movement in translation makes it possible to position the articulation pins 1 projecting from or retracted from the flanks 11*b* of the connecting element 11 so as respectively to enable mounting and demounting of the connecting element 11. As an alternative, each of the housings 11*a* could take the form of a blind hole opening onto the flanks 11*b* and/or provided with bearing surfaces.

The connecting element 11 further includes a recess 2*a* that is particularly visible in FIG. 3 extending from a wall of the connecting element 11 and opening at the level of at least a part of the housings 11*a* of the articulation pins 1 so that the articulation pins can be manipulated by an operative at the level of this recess 2*a*. An attached element 2 which takes the form of a cover in this embodiment is intended to take its place in the recess 2*a*. When it is positioned in this recess the attached element 2 cooperates with the articulation pins 1, as described hereinafter. A fixing element 4 such as a screw enables the attached element 2 to be fixed in the recess 2*a* of the element 11. To this end the connecting element 11 includes an internal thread 4*a*. The attached element 2 is preferably demountable. Furthermore, the attached element 2 advantageously has a shape complementary to that of the recess 2*a*, in particular a volume corresponding or substantially corresponding to that of the recess 2*a*, so that when it is fixed to the connecting element 11 its visible surface espouses or matches the neighbouring surface of the connecting element 11 and/or of the receiving element 21 to form a substantially continuous surface. Because of this arrangement the attached element 2 may be conformed to the articulation device and optimise the aesthetic appearance of the connecting element 11 and/or of the receiving element 21. Additionally, the attached element 2 is preferably arranged on the non-visible side of the connecting element 11. For example, it is provided on the face of the connecting link intended to come into contact with the wrist of the wearer. As an alternative, the attached element may have some other shape, and may in particular project from the connecting element 11 and/or from the receiving element 21. In a further variant it may be fixed to the connecting element by any other means, such as driving, gluing, clipping, welding, brazing, etc. It is therefore not necessarily removable, in which case the part of a strap would not be demountable once fastened to a middle. In another variant the attached element may comprise a number of parts and/or be arranged in the receiving element 21. Consequently, the recess 2*a* may also include a plurality of parts and/or be arranged in the receiving element 21 at the level of at least part of the housings 21*a* of the articulation pins. Of course, the fixing means of the attached element or elements are adapted and/or rearranged accordingly in the receiving element.

In this embodiment the articulation pins 1 have identical shapes and are arranged in a symmetrical manner in the connecting element 11. This connecting element 11 has a shape that is substantially symmetrical with respect to a median plane perpendicular to the axis A1.

In accordance with the invention the articulation device includes at least one articulation pin 1 made entirely of ceramic or based entirely on ceramic, that is to say comprising at least 50% by weight of ceramic, or even at least 75% by weight, or even at least 90% by weight. By the adjective "entirely" is meant that the articulation pin or at least the articulation portions thereof is or are totally made of ceramic or totally based on ceramic, which is to say that the same material occupies all of the volume of the articulation portion or portions of the articulation pin 1, or even occupy all of the volume of the articulation pin 1, or substantially all of that volume. In this embodiment the two articulation pins 1 are preferably identical.

In all the embodiments envisaged it is advantageous to use a technical ceramic and preferably a sintered technical ceramic to form all or part of the articulation pin, as explained hereinabove. The adjective "technical" refers to the high-performance properties of the chosen ceramics. In fact, technical ceramics can achieve excellent mechanical, thermal, even electrical, and/or biochemical properties, as well as chemical inertness and amagnetism, which makes them appropriate for use to form an articulation pin. The technical ceramics used here are distinguished from traditional ceramics by their composition since they are obtained from purified synthetic powders and not from natural mineral powders such as feldspar or kaolin for example.

Furthermore, in all the embodiments envisaged ceramics based on zirconia are advantageously used because they have excellent mechanical properties. The ceramic is advantageously an yttria-stabilised zirconia of type 2Y or 3Y, namely respectively comprising an yttrium molar content of 2% or 3%.

In all the embodiments envisaged the ceramic used for the articulation pin is advantageously a "dense" ceramic, that is to say a ceramic the density of which is between 95% and 100% inclusive of the theoretical density of the ceramic material concerned.

In all cases the material of the articulation pin can be chosen so that the articulation pin or at least its articulation portion or portions have a hardness greater than 800 HV.

As mentioned hereinabove the articulation pin or at least its articulation portion or portions may be entirely made of ceramic, that is to say consist entirely of ceramic. As an alternative, it may be entirely based on ceramic, that is to say entirely made of a material comprising at least 50% by weight of ceramic, complemented by another material such as a metal or a metal alloy for example, thus forming a composite material.

In all cases the articulation pin or at least its articulation portion or portions advantageously take a one-piece monobloc form made entirely of the material defined hereinabove.

In accordance with this embodiment each articulation pin 1 has a continuous and cylindrical articulation portion that extends from a first external end of the articulation pin. This articulation portion defines a first articulation surface 1*a* intended to cooperate with the receiving element 21 and a second articulation surface 1*e* intended to cooperate with the connecting element 11.

To be more precise the receiving element 21 has a first guide surface formed by the peripheral surface of the bore 21*a* intended to cooperate with the first articulation surface 1*a* of the articulation pin 1. The connecting element 11 has a second guide surface formed by the peripheral surface of the housing 11*a* intended to cooperate with the second articulation surface 1*e* of the articulation pin 1. Said guide surfaces and said articulation surfaces are positioned face-to-face for guiding by friction the respective rotation movements of the receiving element 21 and the connecting element 11 relative to said respective articulation pin 1.

Each articulation pin 1 further includes a portion of lower strength positioned outside said articulation portion and in particular out of reach of said guide surfaces 1*a*, 1*e*. This portion of lower strength is arranged at the level of a second internal end of the articulation pin opposite the end toward which is arranged the first articulation surface 1*a*. It forms a functional portion of the articulation pin 1.

In particular this functional portion arranged at the level of this second internal end of each articulation pin 1 forms an abutment surface 1*b*. The attached element 2 has at least one first surface that defines an axial abutment 2*b* or stop intended to cooperate with this abutment surface 1*b* of each articulation pin 1 in order to retain it in the position projecting from the flanks 11*b* of the connecting element 11 when the attached element 2 is fixed to the connecting element 11. In other words, when the attached element 2 is fixed to the connecting element 11 its abutments 2*b* come into contact with the abutment surface 1*b* of the respective articulation pin 1 in the projecting position, thereby preventing the articulation pins 1 from retracting from the flanks 11*b* of the connecting element 11 so that the articulation pins 1 continue to project. The attached element 2 further includes a recess 2*c* at the periphery of the articulation pin 1 and out of reach of the latter.

Furthermore the articulation pin 1 includes in its functional portion a portion of lower strength because of the presence of a groove 1*f*. This groove in particular allows movement in translation of the articulation pin in the retracted position by means of a tool such as a pin or tweezers.

Figure 4:
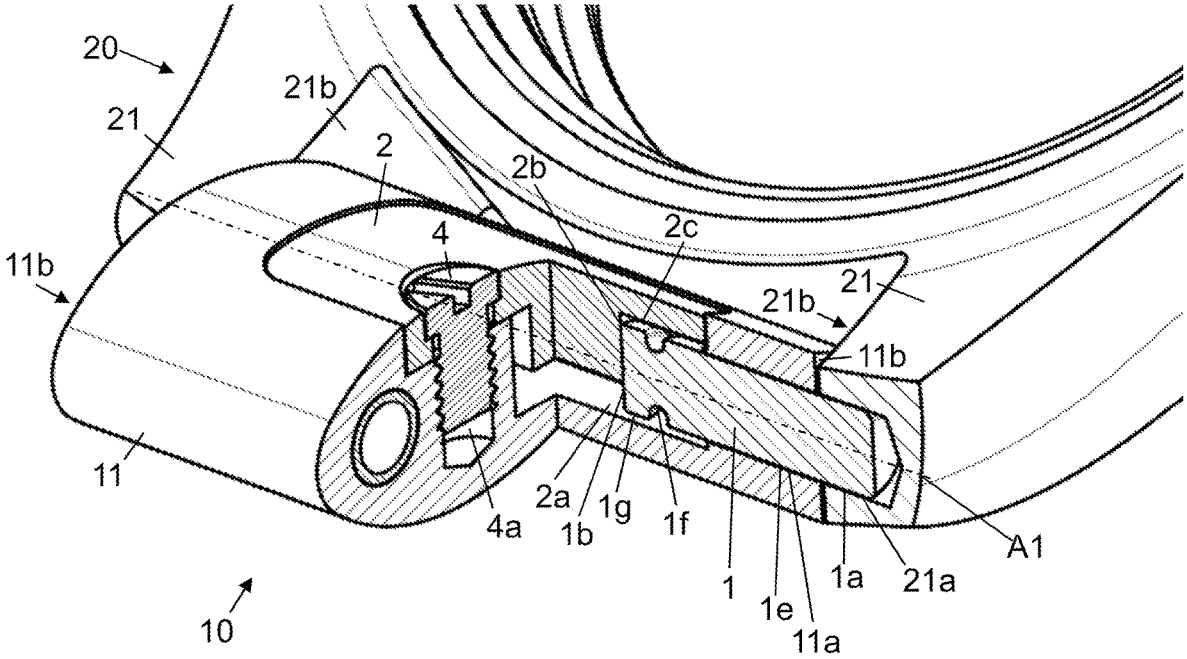
FIG. 4 represents a partially truncated perspective view of the device in accordance with a variant of the first embodiment of the invention for articulation of a part of a strap on a watch middle in an articulated fixing configuration.
Figure 5:
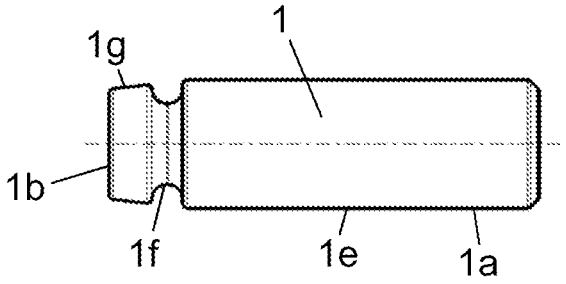
FIG. 5 represents the articulation pin of the device in accordance with the first embodiment of the invention for articulation of a part of a strap on a watch middle.

In accordance with this embodiment the bottom of the groove 1*f* is rounded or radiused in order to limit as much as possible stress concentrations. The groove 1*f* is separated from the abutment surface 1*b* by a part 1*g* of frustoconical shape about the axis A1 having a maximum diameter less than the diameter of the housing 11*a* in which the articulation pin is positioned. The geometry of this portion of lower strength is therefore such that it is never able to come into contact with the housing 11*a* and the recess 2*c* of the attached element 2, as can be seen in FIGS. 2 to 4, even if the articulation pin 1 is at a slant, which could be induced by functional clearances. In other words the clearance between the at least one portion of lower strength and the recess 2*a*, 2*c* is greater than the clearance between the guide surfaces and the articulation surfaces. This articulation pin 1 is represented in particular in FIG. 5. To amplify this effect further the housing 11*a* and the recess 2*c* may feature a clearance around the portion of lower strength of the articulation pin 1 so that the latter is out of reach of any contact with the neighbouring walls during relative rotation. FIG. 4 depicts a variant embodiment of this kind in which the recess 2*a* of the connecting element 11 and the recess 2*c* of the cover are enlarged to create a clearance around the portion of lower strength of the articulation pin 1. In this case the aforementioned frustoconical shape of the portion of lower strength is no longer indispensable and may be replaced by some other, in particular cylindrical, shape. More generally, the functional portion of the articulation pin 1, which here includes one or more portions of lower strength, is advantageously out of reach of the articulation portion or portions and cannot be loaded when the watch is worn. Furthermore the optional frustoconical shape of the part 1*g* further makes it possible to facilitate the insertion of a tool into the groove 1*f* to move the articulation pin toward the retracted position.

In accordance with this embodiment the width of the groove 1*f* in the articulation pin 1 is of the order of 0.3 mm measured in the longitudinal direction of the articulation pin with a diameter less than approximately 0.85 mm. The radius of the rounding at the bottom of the groove is approximately 0.15 mm, i.e. approximately half said width. The diameter of the articulation portion is of the order of 1.3 mm and its length is of the order of 3.6 mm. The total length of the articulation pin is of the order of 4.5 mm.

To summarise, in this embodiment and in the absence of the attached element 2 each articulation pin 1 has two degrees of freedom of movement relative to the connecting element 11: movement in translation along the axis A1 and in rotation on itself about that same axis A1. When the articulation pins 1 are in their position projecting from the connecting element 11 fixing the attached element 2 makes it possible to eliminate the degree of freedom of movement in translation, the articulation pins 1 then remaining locked in their projecting position. These articulation pins 1 retain their degree of freedom of movement in rotation.

The operation of the articulation device in accordance with this embodiment of the invention is described next. When the device is in its fixing configuration, as depicted in FIG. 2, an operative can remove the attached element 2 by unscrewing the screw 4. They therefore access the recess 2*a* in the connecting element and the functional portions of the two articulation pins 1 disposed at least partially in that recess. The operative can therefore move the articulation pins 1 in translation to move them inside the recess 2*a* from their projecting position to their retracted position. To assist this operation each articulation pin 1 preferably includes a groove 1*f* at the level of its functional portion, as mentioned above, which enables the insertion of a simple tool, such as a pin or tweezers, for manual guidance of the movement in translation retracting the two articulation pins. Of course, any other means or tool enabling actuation of the two articulation pins may be envisaged. When this operation is completed the articulation surfaces 1*a* of the articulation pins 1 are housed in the connecting element 11 and escape from the bores 21*a* of the receiving element 21, as represented in FIG. 3. The connecting element 11 can therefore be unfastened from the receiving element 21. The inverse operation enables articulated fixing of the two elements.

In accordance with this embodiment the middle, including its horns, and therefore the receiving element 21 and/or the connecting element 11 is made of metal, in particular of precious metal, such as gold or platinum, so as to be able to obtain a required aesthetic effect.

The invention is not limited to the embodiment described and may incorporate numerous variants. For example, as described above, an attached element 2 can take various forms. Furthermore, an attached element could be provided on a receiving element to cooperate with an articulation pin at the level of the receiving element. This cooperation may consist in blocking the degree of freedom of said articulation pin in movement in translation to retain it in the projecting position. In accordance with a variant, the same attached element or a plurality of attached elements could cooperate both with the connecting element and/or the receiving element. For example, an attached element can therefore be fixed to each of the horns of the middle 20.

In a further variant the receiving element arranged on the middle need not take the form of two horns, but for example the form of a single horn. In this variant the connecting element 11 arranged at the end of the part of a strap could consist of two complementary and distinct lateral elements each incorporating an articulation pin 1, these two articulation pins 1 being intended to occupy positions on respective opposite sides of the single horn to fix the part of a strap to a middle. An attached element is then arranged on the receiving element in the form of a single horn and each lateral element of the connecting element includes a pivot pin projecting into a bore in the single horn. The attached element immobilises these articulation pins in their projecting position. Each lateral element of the connecting element remains mobile in rotation relative to its respective articulation pin. Finally, the middle may therefore include at least one horn, in particular one or two horns. Any other middle architecture may be envisaged, in particular one including an element of the articulation device in accordance with the invention that does not necessarily take the form of one or more horns.

As mentioned above, in accordance with one embodiment the connecting element is arranged at the end of a part of a strap. When the latter includes an assembly of links, in particular metal links, the connecting element advantageously takes the form of a connecting link that has a shape identical or similar to that of other links of the part of a strap to give a continuous aesthetic effect. In accordance with a variant embodiment the part of a strap may be flexible, for example made of leather. In this case the connecting element may be integrated into the end of the flexible part of a strap, preferably in a totally or partially hidden manner. As an alternative it may take the form of a metal end arranged at the end of the flexible part of a strap.

In accordance with a further variant the connecting element is arranged on a watch case, in particular on a middle, and the receiving element is arranged on a part of a strap. For example, the construction of the articulation device described above could be reversed. That is to say, the receiving element 21 could be a part of a strap and the connecting element 11 could be one or more horns of a middle.

In addition to this, in all the variants described above the attached element may include means for acting on a pivot pin during positioning thereof in a recess and/or during its removal from the connecting element and/or from the receiving element, so as to drive said articulation pin in movement in translation to move it automatically from its retracted position to its projecting position and/or vice-versa.

Moreover, an embodiment compatible with all the embodiments described is based on an articulation device in which the attached element is removable. In accordance with an embodiment of this kind the attached element is advantageously removed from the articulation device when the latter is in its first configuration. It is fixed to this articulation device in the second configuration. The invention is nevertheless not limited to an articulation device equipped with an attached element as described. In a simplified variant the articulation device could have only one configuration or be actuated by any means other than by means of an attachment element as described.

More generally, the invention is not limited to the embodiment described and variants thereof. Firstly, it is not limited to an articulated device for the articulated assembly of a part of a strap and a middle but applies to any articulation of two timepiece components, such as two links of the same part of a strap. The embodiment described above and variants thereof can therefore be reproduced for the articulated connection of any two timepiece components.

Additionally, the invention is not limited to the precise geometry of the various elements represented. In particular, the articulation device may include a single articulation pin. It comprises more generally at least one articulation pin. An articulation pin of this kind may take forms other than that represented. For example the articulation portion of an articulation pin could have shapes other than a cylindrical shape. For example this articulation portion and therefore at least one articulation surface could be conical or frustoconical. The cross section of the articulation portion could also be circular or non-circular. It could for example comprise three lobes or have any other continuous shape.

The articulation pin has two articulation surfaces to cooperate by rubbing with each of the two timepiece components. These two articulation surfaces may be substantially juxtaposed on the same articulation portion of the articulation pin. In a variant the articulation pin may comprise two articulation portions. It is mainly by way of this articulation portion or these articulation portions that the articulation pin is subjected to the various loads when the watch is worn.

In all cases the articulation pin includes at least the articulation portion or portions having an entirely continuous peripheral surface, with no sharp edges, and the articulation pin is preferably entirely continuous, with no sharp edges, including the portion or portions of lower strength. Any section of at least the articulation portion or portions of the articulation pin on a median longitudinal plane and any section of at least the articulation portion or portions of the articulation axis on a transverse plane advantageously has a contour of continuous shape. This shape enables it to withstand the mechanical loads to which it is subjected. In fact, stress concentrations are limited as much as possible, consequently optimising the strength of the articulation pin, because it does not have any sharp edges or its profile does not feature any abrupt change of size.

As mentioned above, the articulation pin includes a portion of lower mechanical strength. In accordance with a variant it may include two or more than two portions of lower mechanical strength. This portion or these portions of lower mechanical strength of the articulation pin is/are in a zone out of reach of or distinct from the articulation portions so that these portions of lower strength are not loaded when the watch is worn. In other words the articulation pin includes at least one portion of lower strength and that at least one portion of lower strength is positioned outside said articulation surfaces. Furthermore the at least one portion of lower strength is advantageously part of a functional portion of the articulation pin that is entirely inscribed inside a cylinder having a diameter less than the diameter of the articulation pin at the level of the articulation portion or portions. The portion of lower strength may include a groove that may have a shape other than that represented, which may be any notch around the articulation pin, and not necessarily circular. More generally, the portion of lower strength of the articulation pin corresponds to a zone of the articulation pin that has a cross section transverse to the articulation pin with a lower stiffness (quadratic moment) than the section having the lowest stiffness (the lowest quadratic moment) of the articulation portion.

Figure 6:
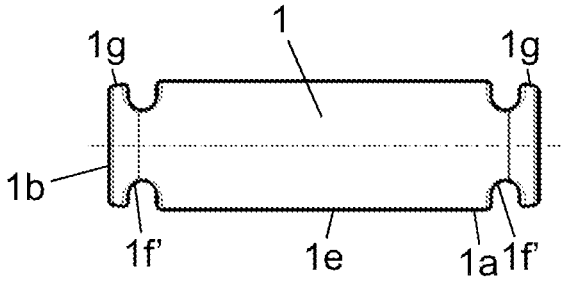
FIG. 6 represents an articulation pin of a device in accordance with a second embodiment of the invention for articulation between two timepiece components.

FIG. 6 depicts by way of example another articulation pin in accordance with the invention in which a groove 1*f*, 1*f'* is arranged at each end of the articulation pin 1, the two guide surfaces 1*a*, 1*e* being positioned in the central part of the articulation pin, on a cylindrical articulation portion. In other words the articulation pin may include two functional portions respectively extending from the two ends of the articulation pin and each having at least one portion of lower strength, the articulation pin including one or two cylindrical central articulation portions forming the articulation surfaces with the first and the second timepiece components.

An articulation pin in accordance with the invention may have a length between 2.9 and 11 mm inclusive. The articulation portion or portions may be cylindrical or non-cylindrical. It or they may be inscribed in a cylinder having a diameter between 0.9 and 2 mm inclusive. The at least one portion of lower strength of the articulation pin may be defined by a groove of rounded shape with no sharp edges. This groove may have a rounded surface. It may have a section on a median longitudinal plane the width of which is between 0.2 and 0.4 mm inclusive. The at least one portion of lower strength may be defined by a groove having a depth less than or equal to 0.7 times said width, or even less than or equal to 0.6 times said width. The groove bottom section may be inscribed in a circle having a diameter greater than or equal to 0.6 times the smallest section of the articulation portion.

With the various features referred to above the articulation pin in accordance with the embodiments of the invention described above is able to resist traction forces in a longitudinal direction of the first timepiece component of at least 200 N without breaking. The various tests carried out have even made it possible to demonstrate that the articulation device with two ceramic articulation pins withstands traction forces on a part of a strap of more than 900 N, i.e. more than 450 N per articulation pin. The dimensions of the portion of lower strength are such that the articulation pin is able to withstand an axial traction force of approximately 20 N in order to guarantee that the articulation pin can be withdrawn from a receiving element without breaking.

The invention also relates to a timepiece as such, in particular a wristwatch, including at least one articulation device as described. An articulation device of this kind is advantageously arranged on respective opposite sides of the watch case, in particular of the middle, for the removable fixing of each part of a strap. It may also serve to interconnect the links of a part of a strap.

The invention claimed is:

1. An articulation device for articulation of two timepiece components, the articulation device including at least one articulation pin and first and second timepiece components connected to one another in an articulated manner using the at least one articulation pin, wherein the two timepiece components each include first and second guide surfaces that cooperate with first and second articulation surfaces respectively of at least one articulation portion of the at least one articulation pin, the guide surfaces and the respective articulation surfaces being positioned face-to-face to guide by rubbing the movement in rotation of the respective timepiece components relative to said at least one articulation pin, the at least one articulation portion of the articulation pin or the at least one articulation pin is made entirely of ceramic, the at least one articulation pin includes at least one portion of lower strength relative to a rest of the articulation pin, the at least one portion of lower strength being positioned out of reach of the guide surfaces of the respective timepiece components, the at least one portion of lower strength being defined by a groove having a rounded shape with no sharp edges, and the at least one articulation portion of the articulation pin or the at least one articulation pin includes an entirely continuous peripheral surface with no sharp edges, or any section of the at least one articulation portion or of the articulation pin on a median longitudinal plane and any section of the at least one articulation portion or of the articulation pin on a transverse plane has a contour of continuous shape.

2. The articulation device according to claim 1, wherein the articulation device includes one or more cylindrical articulation portions with no portion of lower strength, and/or the at least one portion of lower strength is positioned outside the articulation surfaces.

3. The articulation device according to claim 1, wherein the at least one articulation pin has a length in a range of from 2.9 mm to 11 mm and the articulation portion or portions is or are inscribed in a cylinder having a diameter in a range of from 0.9 mm to 2 mm, and/or the at least one portion of lower strength of the at least one articulation pin is defined by the groove having a rounded surface having a width in a median longitudinal plane in a range of from 0.2 mm to 0.4 mm and a depth less than or equal to 0.7 times the width, and/or the at least one portion of lower strength of the at least one articulation pin is defined by the groove having a groove bottom section inscribed in a circle having a diameter greater than or equal to 0.6 times a smallest section of the at least one articulation portion.

4. The articulation device according to claim 1, wherein the at least one articulation pin includes a functional portion extending from a first end of the articulation pin and including the at least one portion of lower strength outside any guide surface, juxtaposed to the at least one articulation portion forming the articulation surfaces with the first and second timepiece components or juxtaposed to two distinct articulation portions forming the respective articulation surfaces with the first and second timepiece components, or the articulation pin includes two functional portions extending from the respective ends of the at least one articulation pin and each having at least one portion of lower strength, the articulation pin including at least one central articulation portion forming the articulation surfaces with the first and second timepiece components.

5. The articulation device according to claim 1, wherein the at least one portion of lower strength is part of a functional portion of the at least one articulation pin that is entirely inscribed in a cylinder having a diameter less than a diameter of the at least one articulation pin at the at least one articulation portion.

6. The articulation device according to claim 5, wherein the functional portion includes a part having a frustoconical shape.

7. The articulation device according to claim 1, wherein the first timepiece component and/or the second timepiece component includes or include a recess around the at least one portion of lower strength.

8. The articulation device according to claim 1, wherein the at least one portion of lower strength has a continuous peripheral surface.

9. The articulation device according to claim 1, wherein the at least one articulation pin is a one-piece monobloc made entirely of ceramic.

10. The articulation device according to claim 1, wherein the at least one articulation pin is based on a technical ceramic, or is made entirely of a technical ceramic, or is made of a composite material based on a ceramic.

11. The articulation device according to claim 1, wherein the at least one articulation pin has a hardness greater than or equal to 800 HV.

12. The articulation device according to claim 1, wherein the first and second timepiece components are strap links, or the first timepiece component is a part of a strap and the second component is a watch case or middle.

13. The articulation device according to claim 11, wherein the first timepiece component is a watch middle, the second timepiece component is a part of a strap, the articulation device includes a connecting element intended for connection to a respective part of a strap or a watch middle, and including a housing in which the at least one articulation pin is arranged, and at least one attached element, the articulation device being designed to occupy at least two configurations:

a first configuration in which the at least one articulation pin is free to move in translation in the housing of the connecting element so as to be able to occupy a position projecting from the connecting element and a position retracted into the housing; and a second configuration in which the at least one attached element cooperates with the at least one articulation pin to retain it in its position projecting from the connecting element.

14. The articulation device according to claim 13, wherein the at least one attached element is removable and includes at least one first abutment that cooperates with a first surface of the at least one articulation pin in the second configuration of the articulation device so as to prevent the articulation device from moving in translation in the housing and to retain the articulation device in a position projecting from the connecting element, and the at least one attached element is removed from the articulation device in the first configuration.

15. A timepiece including at least one articulation device according to claim 1.

16. The articulation device according to claim 3, wherein the at least one portion of lower strength of the at least one articulation pin is a groove with a rounded surface having a width in a median longitudinal plane in a range of from 0.2 mm to 0.4 mm and a depth of less than or equal to 0.6 times the width.

17. The articulation device according to claim 10, wherein the at least one articulation pin is based on a sintered technical ceramic.

18. The articulation device according to claim 17, wherein the sintered technical ceramic is based on zirconia.

19. The articulation device according to claim 10, wherein the at least one articulation pin is made entirely of a sintered technical ceramic.

20. The articulation device according to claim 10, wherein the at least one articulation pin is made of a composite material based on a ceramic including metal.

21. The articulation device according to claim 6, wherein the part having the frustoconical portion is an end portion of the articulation pin separating the groove from a transverse abutment surface of the articulation pin.

22. An articulation device for articulation of two timepiece components, the articulation device including at least one articulation pin and first and second timepiece components connected to one another in an articulated manner using the at least one articulation pin, wherein the two timepiece components each include first and second guide surfaces that cooperate with first and second articulation surfaces respectively of at least one articulation portion of the at least one articulation pin, the guide surfaces and the respective articulation surfaces being positioned face-to-face to guide by rubbing the movement in rotation of the respective timepiece components relative to said at least one articulation pin, the at least one articulation portion of the articulation pin or the at least one articulation pin is made entirely of ceramic, the at least one articulation pin includes at least one portion of lower strength relative to a rest of the articulation pin, the at least one portion of lower strength being positioned out of reach of the guide surfaces of the respective timepiece components, the at least one portion of lower strength being defined by a groove, the at least one portion of lower strength being separated from a transverse abutment surface of the articulation pin by an end portion of the articulation pin having a maximum transverse dimension smaller than a maximum transverse dimension of the articulation portion, and the at least one articulation portion of the articulation pin or the at least one articulation pin includes an entirely continuous peripheral surface with no sharp edges, or any section of the at least one articulation portion or of the articulation pin on a median longitudinal plane and any section of the at least one articulation portion or of the articulation pin on a transverse plane has a contour of continuous shape.

23. The articulation device according to claim 22, wherein the end portion has a frustoconical shape.

* * * * *